US009302463B2

(12) United States Patent
Heidrich et al.

(10) Patent No.: US 9,302,463 B2
(45) Date of Patent: Apr. 5, 2016

(54) CONTAINER TREATMENT MACHINE FOR PRINTING ON CONTAINERS

(71) Applicant: KRONES AG, Neutraubling (DE)

(72) Inventors: Andreas Heidrich, Donaustauf (DE); Florian Lauterbach, Neutraubling (DE); Bernd Schroll, Regensburg (DE); Daniel Hartl, Nittenau (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 14/453,221

(22) Filed: Aug. 6, 2014

(65) Prior Publication Data

US 2015/0059600 A1 Mar. 5, 2015

(30) Foreign Application Priority Data

Sep. 4, 2013 (DE) ..... 10 2013 217 659

(51) Int. Cl.

| | |
|---|---|
| ***B41F 17/28*** | (2006.01) |
| ***B41F 17/30*** | (2006.01) |
| ***B41F 17/18*** | (2006.01) |
| ***B41F 17/00*** | (2006.01) |
| ***B41J 3/407*** | (2006.01) |
| ***B41J 11/00*** | (2006.01) |

(52) U.S. Cl.

CPC ..... *B41F 17/28* (2013.01); *B41F 17/006* (2013.01); *B41F 17/18* (2013.01); *B41F 17/30* (2013.01); *B41J 3/4073* (2013.01); *B41J 11/002* (2013.01); *B41P 2217/00* (2013.01)

(58) Field of Classification Search

CPC ..... B41F 17/006; B41F 17/14; B41F 17/16; B41F 17/18; B41F 17/28; B41F 17/30; B41P 2217/00; B41P 2217/61; B41P 2217/62

See application file for complete search history.

(56) References Cited

U.S. PATENT DOCUMENTS

| | | | | |
|---|---|---|---|---|
| 6,135,654 | A * | 10/2000 | Jennel | 400/61 |
| 6,646,278 | B1 | 11/2003 | Schwarz et al. | |
| 6,920,822 | B2 * | 7/2005 | Finan | 101/38.1 |
| 9,032,872 | B2 * | 5/2015 | Uptergrove | 101/38.1 |
| 2014/0285600 | A1 * | 9/2014 | Domeier et al. | 347/102 |

FOREIGN PATENT DOCUMENTS

| | | | |
|---|---|---|---|
| DE | 19516053 | A1 | 11/1996 |
| DE | 102009041527 | A1 | 2/2011 |

(Continued)

OTHER PUBLICATIONS

German Search Report for Application No. 102013217659.7, dated Mar. 31, 2014.

*Primary Examiner* — Jill Culler
*Assistant Examiner* — Marissa Ferguson Samreth
(74) *Attorney, Agent, or Firm* — Marshall, Gerstein & Borun LLP

(57) ABSTRACT

A container treatment machine for printing on containers, including a transport unit optionally configured as a carousel and used for conveying the containers in circulating container reception apparatus, at least one direct printing head for printing with a light-curing printing ink, and a stationary curing unit for curing the printing ink on the containers by light radiation, optionally UV light radiation, characterized in that each of the container reception apparatuses is provided with a shielding enclosure used for shielding off light radiation and having at least one access opening for the curing unit, and the curing unit is provided with a shielding element cooperating with the access opening of at least one shielding enclosure such that direct exit of light is prevented.

25 Claims, 3 Drawing Sheets

(56) References Cited

FOREIGN PATENT DOCUMENTS

| | | | | | |
|---|---|---|---|---|---|
| DE | 102009013477 | B4 | | 1/2012 | |
| DE | 102010034780 | A1 | | 2/2012 | |
| DE | 102011119171 | B3 | | 2/2013 | |
| JP | 2013-215647 | A | | 10/2013 | |
| WO | WO-2004/054810 | A1 | | 7/2004 | |
| WO | 2009018893 | | * | 2/2009 | ..... B41J 3/407 |
| WO | 2011018191 | | * | 2/2011 | ..... B41F 17/18 |

* cited by examiner

CONTAINER TREATMENT MACHINE FOR PRINTING ON CONTAINERS

CROSS-REFERENCE TO RELATED APPLICATION

The present application claims priority to German Application No. 102013217659.7, filed Sep. 4, 2013. The priority application, DE 102013217659.7, is hereby incorporated by reference.

FIELD OF THE DISCLOSURE

The present invention relates to a container treatment machine used for printing on containers.

BACKGROUND

Normally, containers for products, such as beverages, sanitary articles and the like, are provided with an imprint for identifying the product and/or for high-quality product presentation. The imprint may be applied directly to the outer surface of a container and/or to a label as additional print and it may comprise e.g. characters, logos, patterns and color gradients. For applying the imprint, the containers are normally conveyed by a transport unit, e.g. a carousel, and, while being conveyed, they are printed on e.g. with light-curing printing inks by means of direct printing heads. For multicolor printing, the container treatment machine may have arranged thereon a plurality of direct printing heads with printing inks of different colors.

The initially liquid printing ink is irradiated on the containers, e.g. with UV light by means of a curing unit arranged on the carousel in a stationary manner, and is thus cured. The container treatment machine may comprise a plurality of curing units, which cure the printing ink after printing of a respective color. Alternatively, it is also imaginable that the curing unit is arranged downstream of all the direct printing heads, when seen in the conveying direction, so that the printing inks of all colors are cured simultaneously. Finally, also a combination is imaginable, in the case of which a so-called pinning (initial curing) is carried out, e.g. with UV LEDs after each printing head, and the whole imprint is then hardened at the end.

The above is, however, disadvantageous insofar as direct light radiation or scattered light of the curing unit falls onto the direct printing heads where it inadvertently cures the printing ink. The nozzles of a direct printing head may thus clog and/or the print quality of direct printing may be impaired.

SUMMARY OF THE DISCLOSURE

It is therefore the object of the present invention to provide a container treatment machine for printing on containers, in the case of which clogging of nozzles of the direct printing head and/or a deterioration of the print quality through inadvertently cured printing ink is avoided. In addition, the machine serves to minimize, through shielding, the operator's health risks caused by UV radiation and to prevent UV-sensitive components in the interior of the machine from damage.

Each of the container reception means is provided with a shielding enclosure used for shielding off light radiation and having at least one access opening for the curing unit, and the curing unit is provided with a shielding element cooperating with the access opening of at least one shielding enclosure such that direct exit of light is prevented.

Due to the fact that each of the container reception means is provided with a shielding enclosure having an access opening, the containers can be irradiated by the curing unit through the access opening without the light radiation being interfered with. Since, in addition, each of the container reception means is provided with a separate shielding enclosure, neither direct light radiation nor scattered light from the area of a container reception means will arrive at neighboring container reception means or the direct printing heads. The shielding enclosure will additionally prevent the light radiation, which is emitted by the curing unit, from passing through a transparent container into the interior of the transport unit and from being then scattered to the direct printing heads.

In addition, the curing unit has formed thereon the shielding element in opposed relationship with the access opening, so that the access opening is closed against an exit of light during a movement past the curing unit. Direct light from the curing unit or scattered light is thus prevented from exiting the access opening and from arriving then at the direct printing head.

It follows that the container, when irradiated in the area of the curing unit, is positioned in a substantially closed chamber formed in this area and defined by the shielding enclosure and by the shielding element. This prevents, at least to a large extent, light radiation of the curing unit from arriving directly or via scattered light paths at a direct printing head, where it would inadvertently cure the printing ink or cause clogging of the nozzles.

The container treatment machine for printing on containers may be arranged in a beverage processing plant. The container treatment machine may be arranged downstream of a filling plant for filling a product into the containers. The container treatment machine may also be arranged directly downstream of a stretch blow molding machine for PET bottles. The containers may be provided for accommodating therein beverages, sanitary articles, pastes, chemical, biological and/or pharmaceutical products. The containers may be plastic bottles, glass bottles, cans and/or tubes. Plastic containers may especially be PET, HDPE or PP containers or bottles.

The transport unit with the container reception means and the at least one direct printing head may be configured for printing on a stream of containers continuously or cyclically. The transport unit may be a carousel on the circumference of which the container reception means are arranged. The container reception means may each comprise a rotary plate, optionally driven by a direct drive, and a centering device. The rotary plate and the centering device may be configured such that the bottom or the opening of the container can be fixed in position. The carousel may have associated therewith an infeed star wheel and/or a discharge star wheel so as to feed the containers to and/or remove them from the container reception means. A drive in the container treatment machine can be provided for rotating the carousel about a perpendicular carousel axis. "Perpendicular" describes here the direction whose vector is directed to the geocenter. In addition, the carousel may have a carousel plane that extends perpendicular to the carousel axis.

The direct printing heads may be configured for printing with an inkjet printing method. "Inkjet printing method" may here mean that the printing ink can be applied to the containers by means of a plurality of nozzles. The nozzles may each comprise a thermocouple or a piezo element. In addition, the nozzles may be configured for ejecting printing droplets in a printing direction onto the containers. The direct printing head may also be configured for use with any other direct printing method for computer-controlled ejection of printing droplets onto the containers.

The at least one direct printing head may be arranged on the container treatment machine in a stationary manner. "Stationary" may here mean that the direct printing head does not circulate together with the transport unit. "Light-curing printing ink" may mean that the light radiation triggers in the printing ink a chemical reaction through which the liquid printing ink is converted into a substantially solid or pasty phase. The printing ink may be polymerized through the light radiation. Optionally thereto, radicals from added photoinitiators are formed in the printing ink. "Printing ink" may here mean that the substance in question is an ink, a dye, a lacquer or the like.

The curing unit may comprise a light source, optionally a UV light source. Normally, UV light radiation in a wavelength range of 200-480 nm is used for curing light-curing printing inks. The light source may be a medium pressure mercury vapor lamp, a high pressure mercury vapor lamp or a super high pressure mercury vapor lamp. Likewise, the light source may be a gas discharge lamps, an arc lamp, a UV light emitting diode, or a xenon UV flash lamp.

"Stationary" curing unit may here mean that the curing unit is fixedly arranged on the container treatment machine. In other words, this may mean that the curing unit does not circulate together with the transport unit. The curing unit may be arranged on the container treatment machine such that, when the machine is in operation, the containers are moved by means of the transport unit past the stationary curing unit for curing the printing ink.

The shielding enclosure may be arranged in a channel-like manner between the rotary plate and the centering device of the container reception means. Both ends of the channel-like shielding enclosure may be provided with a respective end cover. The shielding enclosure may be configured as a curved and/or angled sheet metal element. Likewise, the shielding enclosure may comprise a plurality of joined sheet metal elements. The shielding enclosure may have the configuration of a chamber enclosing the container reception means. The access opening may be formed between the longitudinal edges of the channel-like shielding enclosure. When the transport unit is configured as a carousel, the access opening of the shielding enclosure may be configured such that it is directed radially outwards. The stationary curing unit may here be configured such that a light exit opening thereof is oriented radially inwards towards the axis of the carousel, the light exit opening corresponding optionally with at least one access opening of the shielding enclosures during operation.

The shielding element of the curing unit may comprise at least one sheet metal element that overlaps the shielding enclosure. The shielding enclosure and the shielding element may be configured such that they define a chamber for curing the printing ink. That direct exit of light is prevented may mean that the shielding enclosure and the shielding element cooperate such that, starting from the curing unit and/or from the container surface, a light beam is reflected on or scattered by the shielding element or the shielding enclosure at least once prior to exiting the chamber defined by the shielding element and the shielding enclosure. The shielding element and/or the shielding enclosure may have a surface coating that reflects the light radiation in a range of 0-30%, optionally in a range of 0-10%. The shielding element and/or the shielding enclosure may be substantially light absorbing. For better absorption of light radiation impinging at a flat angle, the shielding element and/or the shielding enclosure may be provided with a structured surface, optionally with flutes.

The shielding enclosure may be configured in a U-shape along a longitudinal axis of the container reception means and the access opening may be defined by the free ends of the U-shape substantially parallel to the conveying direction of the transport unit. The U-shaped configuration of the shielding enclosure allows the latter to be produced from a metal sheet in a particularly easy manner and, consequently, at a particularly reasonable price. "U-shaped" may here mean that a cross-section of the shielding enclosure substantially has a U-profile. "U-shaped" may also mean that the shielding enclosure is defined by a rectangular profile that is open substantially at one side thereof. When the conveying unit is configured as a carousel, the U-shape may open radially outwards. "Conveying direction or transport direction" may mean that this is the direction in which the container reception means move when the machine is in operation.

The shielding element may be configured such that it extends from the edges of a light exit opening of the curing unit like an umbrella beyond the edges of the access opening. This prevents light radiation from advancing beyond the edges of the light exit opening and arriving at the printing head. That the shielding element is configured like an umbrella may mean that the shielding element projects beyond edges of the light exit opening substantially parallel to the conveying direction. The shielding element should project at both sides of the curing unit preferably by at least one, better still 1.5 to 2, shielding widths, so as to form a beam labyrinth in the best possible way. In addition, this may mean that an upper and/or a lower edge of the shielding element overlap(s) with respective ends of the shielding enclosure.

The shielding element and/or a housing of the curing unit may comprise air exchange openings, which are each configured as a beam labyrinth by means of overlapping elements. This avoids the formation of air pulsation, which may otherwise occur due to the movement of the transport unit and the continuously closing and opening curing chambers and which would result in variations in the light spectrum of the curing unit. "Labyrinth-like" may here mean that the overlapping elements are spaced apart, but displaced relative to one another such that a direct passage of light is not possible.

The distance between the curing unit and the container reception means may be adjustable by means of a linear displacement unit. This allows, on the one hand, an adaptation of the irradiation intensity on the container surface and, on the other hand, an adaptation of the curing unit to various types of containers (e.g. containers having different diameters). The linear displacement unit may be configured for displacing the curing unit perpendicular to the conveying direction of the transport unit. The linear displacement unit may comprise a guide rail and/or a spindle. "Distance" may here mean that this is the perpendicular distance between the curing unit and the conveying direction of the transport unit.

The linear displacement unit may be provided with a drive which is controllable via a machine control for adjusting the distance. The linear displacement unit can thus be displaced through a control command in a particularly precise manner and/or automatically. The drive may be a direct drive, e.g. a servomotor or a stepping motor. The servomotor may comprise a rotary encoder for detecting the angular position of the motor shaft. The distance between the linear displacement unit and the container surface can thus be calculated precisely via the pitch of the spindle. In addition, the linear displacement unit may comprise a stop for absolute referencing.

The machine control may communicate with a type management for retrieving adjustment parameters of the linear displacement unit. The curing unit distance can thus be adapted automatically to the type of container used. The type management may be a database in the machine control or in a remote computer unit.

The shielding element may be configured such that it is adjustable via an adjustment mechanism, which is optionally provided with elongate holes, relative to a light source of the curing unit. It is thus possible to adjust the distance between the shielding element and the shielding enclosure after a displacement of the curing unit. The exit of light between the shielding element and the shielding enclosure is thus minimized.

The curing unit may be configured such that it is pivotable by means of a pivot joint from an operating position to a maintenance position. The light source in the curing unit can thus be accessed in a particularly easy manner for the purpose of exchange. The axis of rotation of the pivot joint may be oriented substantially parallel to the conveying direction of the transport unit.

The curing unit is adapted to be arrested at the operating position by means of a locking element. This guarantees that no inadvertent pivoting of the curing unit is possible at the operating position. The locking element may be a tension lock. In addition, the curing unit may comprise positioning elements, so that, after having been repeatedly pivoted, the curing unit can always be arrested at the same operating position.

A safety sensor or a safety switch on the curing unit may be configured such that the curing unit is automatically deactivatable at the maintenance position. This guarantees that, during maintenance, the curing unit will not inadvertently emit light radiation, which may perhaps be harmful to health. The curing unit can thus be serviced in a particularly safe manner. The safety sensor or safety switch may be formed between two legs that are connected to the pivot joint for the purpose of pivoting. The safety sensor or safety switch may be configured for deactivating the light source in the curing unit. In addition, the structural design may be configured such that the radiation source can only be pivoted to the maintenance position when the supply lines have been separated. Risks for the operator are thus excluded even more reliably. Furthermore, the sensor may be configured such that it is able to detect, with the machine running, whether the radiation source is at an inclined position, i.e. not at a precisely perpendicular position, and whether there is consequently the risk of an escape of scattered radiation.

The curing unit may comprise an activated-carbon system for filtering the waste air. The ozone, which is normally produced by UV light sources having a significant UV-C component, is thus filtered out of the waste air. Health risks caused by ozone for the operating staff are avoided in this way. The activated-carbon system may comprise an activated-carbon filter and/or a fan. In addition, the activated-carbon system may be arranged within a housing of the curing unit or outside of the housing of the curing unit. The activated-carbon system may be connected to the housing of the curing unit via a hose.

Supply lines, such as cooling water lines, cooling air and/or waste air lines as well as pneumatic and electric lines of the curing unit, can be adapted to be detached by means of quick-release fasteners. The curing unit can thus be detached from the container treatment machine in a particularly fast manner during a maintenance or exchange operation. The quick-release fasteners may be plugs or connection flanges in air or fluid lines.

Supply lines may be suspended by means of a tarable tackle system. The curing unit can thus be supplied from above. When the curing unit is pivoted from the operating position to the maintenance position, the supply lines are moved together therewith through the tarable tackle system. The supply lines will thus not obstruct the operating staff carrying out the maintenance work.

Additional features and advantages of the present invention will be explained hereinbelow on the basis of the embodiments shown in the figures, in which:

DETAILED DESCRIPTION OF THE PREFERRED EMBODIMENTS

Figure 1:
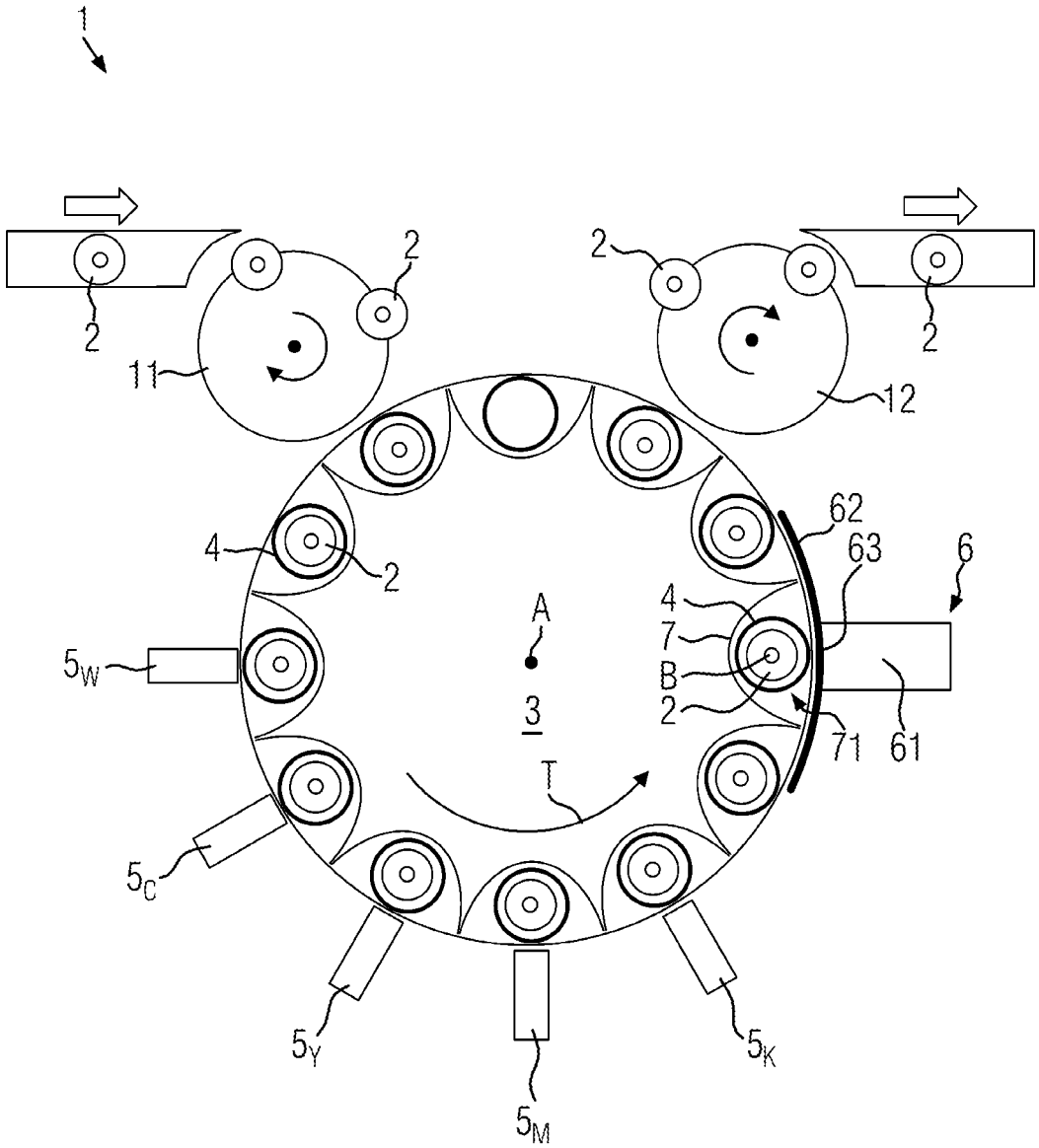
FIG. 1 shows a representation of a container treatment machine for printing on containers in the top view.

FIG. 1 shows a representation of the container treatment machine 1 for printing on containers 2 in a top view. It can be seen that the containers 2 are first placed, via the infeed star wheel 11, in the container reception means 4 of the transport unit 3 configured as a carousel. The container reception means 4 are here configured such that they are rotatable about the longitudinal axes of the containers by means of a direct drive (not shown here). By means of the carousel 3, the containers 2 are moved past the direct printing heads $\mathbf{5}_W$, $\mathbf{5}_C$, $\mathbf{5}_Y$, $\mathbf{5}_M$ and $\mathbf{5}_K$ for printing with light-curing printing inks. After having been printed on, the containers 2 are irradiated with UV light radiation by means of the curing unit 6, whereby the printing ink cures. Subsequently, the containers 2 are removed from the container reception means 4 by the discharge star wheel 12 and supplied to further processing stations (e.g. a packaging station).

The direct printing heads 5 work here according to the inkjet printing method. The light-curing printing ink is here taken from an ink supply and sprayed directly onto the surface of the containers 2 via a plurality of print nozzles. The containers 2 can thus be provided with an individual print image. By means of each of the direct printing heads $\mathbf{5}_W$, $\mathbf{5}_C$, $\mathbf{5}_Y$, $\mathbf{5}_M$ and $\mathbf{5}_K$, the containers 2 are sequentially printed on with the different colors white, cyan, yellow, magenta and black one after the other, so as to generate a multi-color print image. Immediately after the last direct printing head $\mathbf{5}_K$ the printing inks on the container surface are substantially liquid.

The curing unit 6 comprises here a housing 61 having arranged therein a UV light source (not shown) that radiates UV light in a wavelength range of 200-480 nm through the light exit opening 63 onto the containers 2. Simultaneously, the container 2 rotates about the axis of rotation B. This rotation has the effect that the printing ink is cured along the entire circumference of the container 2. Curing without rotation is possible as well, e.g. in the case of continuous curing of special-shaped containers.

In order to protect the direct printing heads $\mathbf{5}_W$-$\mathbf{5}_K$ against inadvertent curing of the printing ink, each of the container reception means 4 is provided with a shielding enclosure 7 having an access opening 71 for the curing unit 6. The shielding enclosure 7 is here U-shaped, i.e. it has a U-profile when seen in a cross-sectional view. The ends of the U-profile of neighboring shielding enclosures 7 are interconnected and arranged essentially on the outer circumference of the carousel 3. The light radiation of the curing unit 6 can thus not enter the interior of the carousel 3, where also UV light-sensitive components may be provided, and proceed from said interior via scattered light paths to the direct printing heads $\mathbf{5}_W$-$\mathbf{5}_K$.

In addition, the curing unit 6 comprises the shielding element 62, which covers the access opening 71 of the shielding enclosure 7 beyond the edges thereof. To this end, the shielding element 62 is configured such that it extends like an umbrella beyond the edges of the access opening 71. This can be seen from the fact that the ends of the shielding element 62 continue to extend along the neighboring shielding enclosures 7. When seen in the conveying direction T, the length of the shielding element 62 exceeds that of the access opening 71 of the shielding enclosure 7 by 100%.

During the printing process and the curing of the printing ink, the containers 2 in the container reception means 4 are continuously conveyed by means of the carousel 3. It is also imaginable that the containers 2 are conveyed in a cyclic operation mode and stopped in front of the direct printing heads $\mathbf{5}_W$-$\mathbf{5}_K$ and in front of the curing unit 6, respectively. In other words, the containers 2 are, in the cyclic operation mode, positioned in directed opposed relationship with the individual direct printing heads $\mathbf{5}_W$-$\mathbf{5}_K$ and are only rotated about their longitudinal axes B in the container reception means 4.

Figure 2:
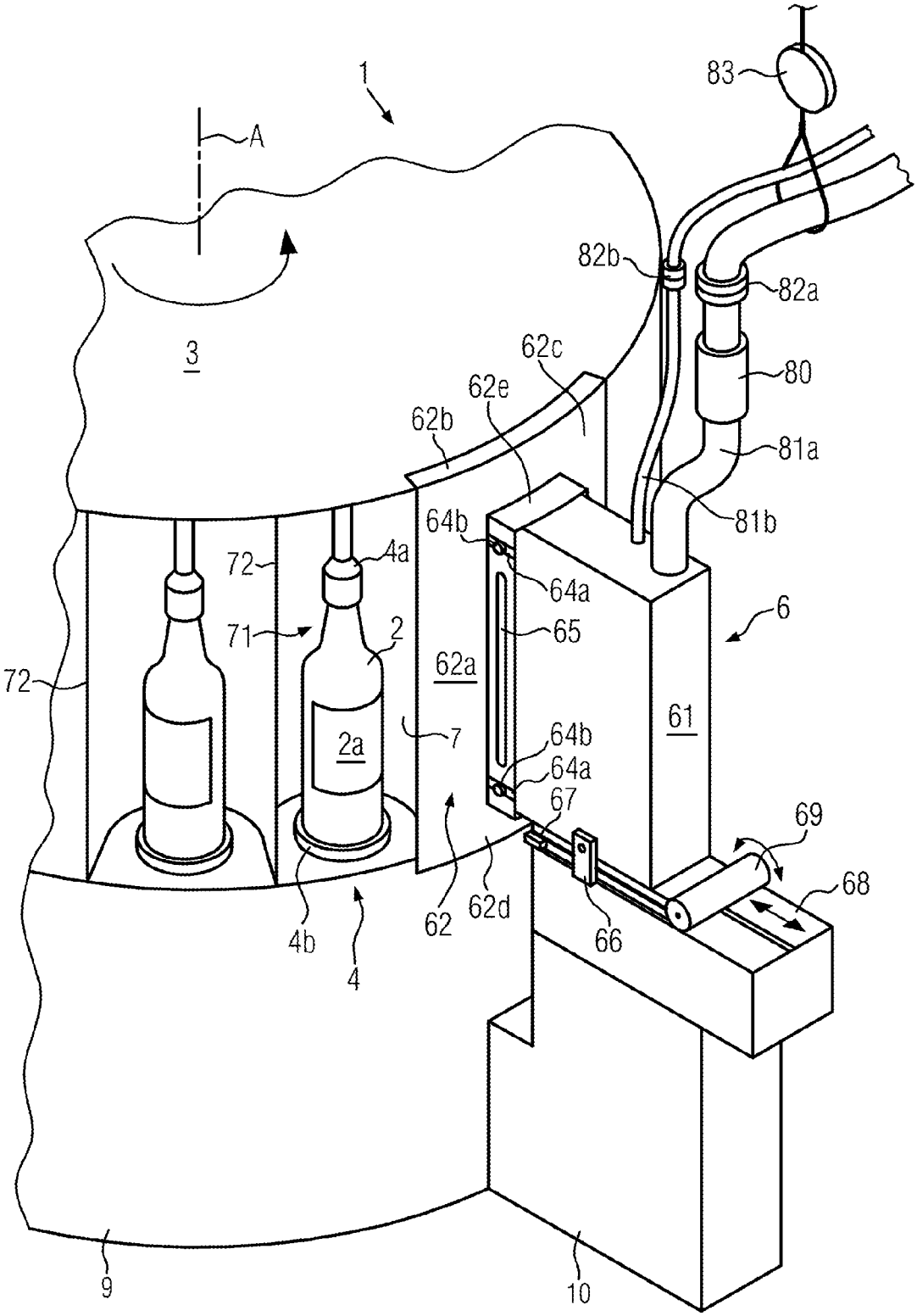
FIG. 2 shows a perspective view of a partial representation of the container treatment machine according to FIG. 1.

FIG. 2 shows a perspective view of a partial representation of the container treatment machine 1 according to FIG. 1. The figure essentially shows the carousel 3 in the area of the curing unit 6.

The carousel 3 is arranged such that it is rotatable about the axis of rotation A relative to a machine base 9. The carousel 3 has arranged thereon regularly spaced container reception means 4 in which the respective containers 2 are fixed in position, each by means of the centering device 4*a* and the rotary plate 4*b*. Furthermore, the figure shows that each of the container reception means 4 includes a shielding enclosure 7 configured as a U-shaped sheet metal plate extending around the axis of rotation of the container reception means 4. Two edges 72 of the U-shaped shielding enclosure 7 define a respective access opening 71.

In addition, it can be seen that the curing unit 6 is secured to the extension 10 of the machine base 9 in a stationary manner. The linear displacement unit 68, with the aid of which the curing unit 6 can be displaced radially to the axis of rotation A of the carousel 3 along the double arrow, is arranged between the extension 10 and the curing unit 6. The distance between the curing unit 6 and the container 2 is adjusted in this way. The linear displacement unit 68 comprises here a servomotor, a spindle and guide rails (not shown here). In addition, the curing unit 6 is adapted to be pivoted by means of the pivot joint 69 and can, for the purpose of maintenance, be pivoted outwards away from the carousel 3 (shown more precisely in FIGS. 3A and 3B). The locking element 66, which is configured as a quick-release lock, is used for arresting the pivot joint 69. The figure additionally shows that the safety switch 67 is arranged in the area of the two legs interconnected by the pivot joint 69 and detects a pivoting movement of the curing unit 6. The curing unit 6 is thus automatically deactivated during maintenance for reasons of safety of the operating staff.

Furthermore, the figure shows that the curing unit 6 comprises the shielding element 62, which cooperates with the access opening 71 of the shielding enclosure 7. Thus, respective substantially closed chambers are formed when the container reception means 4 move past the curing unit 6, said chambers preventing an escape of light. The shielding element 62 has an umbrella-like configuration and comprises the wings 62*a* and 62*c*, which are formed cylindrically largely along the outer circumference of the carousel 3 when seen in the conveying direction, as well as the two boundary elements 62*b* and 62*d* formed at the top and at the bottom. The two wings 62*a* and 62*c* project into the adjoining container reception means 4 and the shielding enclosures 7 associated therewith.

The shielding element 62 exhibits a gap towards the edges 72 of the shielding enclosure 7, said gap guaranteeing that the carousel 3 can easily be rotated. Due to the fact that the wings 62*a* and 62*c* are slightly curved, light is prevented from exiting directly up to the direct printing heads $\mathbf{5}_W$-$\mathbf{5}_K$ shown in FIG. 1. In addition, the upper and the lower boundary elements 62*b* and 62*d* overlap the respective end faces of the shielding enclosures 7 and the carousel 3, so that light radiation cannot escape, neither upwards nor downwards.

In addition, the shielding element 62 is connected to the housing 61 of the curing unit 6 via the collar 62*e* and can be adjusted by means of the adjustment devices 64*a*, 64*b*. This allows, in the case of a displacement of the linear displacement unit 68, an adjustment of the changed distance between the shielding element 62 and the shielding enclosures 7. To this end, the screws 64*b* are loosened and the shielding element 62 can be displaced radially with respect to the carousel 3 through the elongate holes 64*a* formed in the collar 62*e*. Subsequently, the screws 64*b* are tightened again.

The figure additionally shows that the collar 62*e* has formed therein the air exchange openings 65, which, by means of overlapping elements that are here not shown, form a respective beam labyrinth. The air supplied by the shielding enclosures 7 during rotation of the carousel 3 can thus escape but also enter through the air exchange openings 65, whereby a constant pressure is established in front of the curing unit 6.

In addition, the supply lines 81*a* for air and 81*b* for electric current and also water cooling lines are outlined. Via the hose 81*a* air is discharged from the curing unit 6 and filtered by means of the activated-carbon system 80. The latter comprises an activated-carbon filter and a centrifugal fan (neither of them shown here). During maintenance, the supply lines 81*a* and 81*b* can easily be separated by means of the quick-release fasteners 82*a* and 82*b*. The tarable tackle system 83 is additionally provided for keeping the supply lines 81*a* and 81*b* up. When the curing unit 6 is pivoted away, the supply lines 81*a* and 81*b* are moved together therewith, so that they will not obstruct the operating staff carrying out the maintenance work.

Figure 3A:
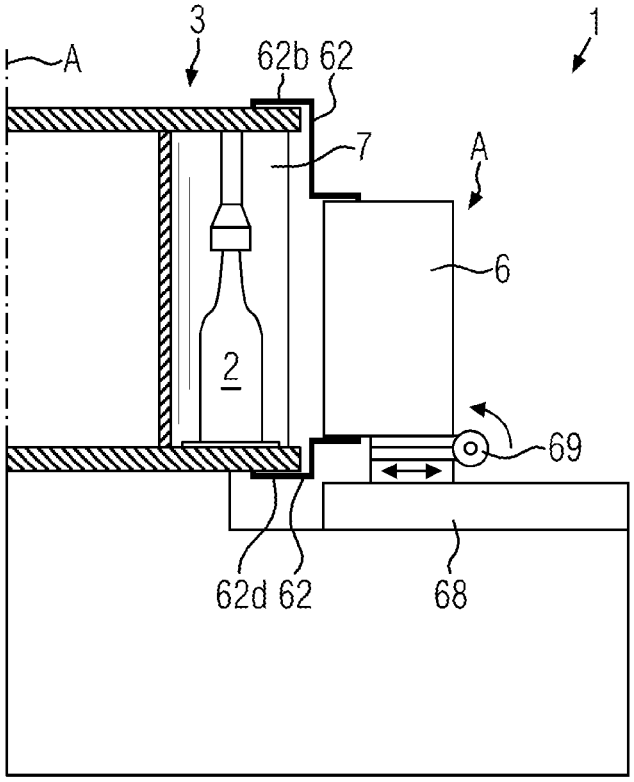
FIG. 3A shows a side view of the curing unit of the container treatment machine according to FIG. 1 at an operating position.
Figure 3B:
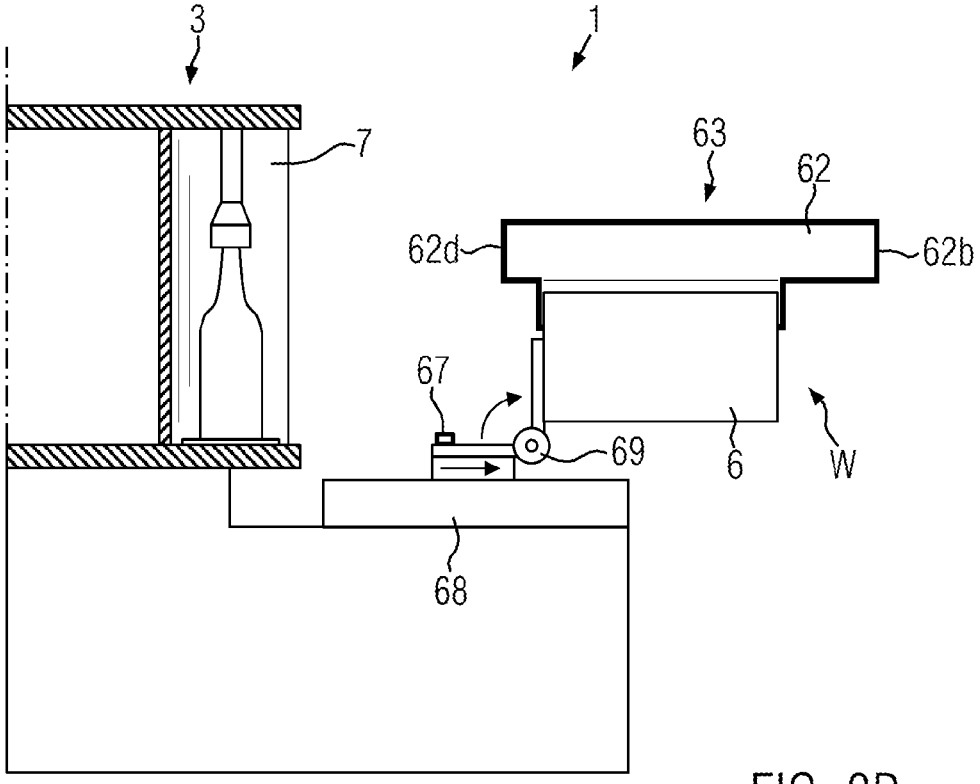
FIG. 3B shows a side view of the curing unit of the container treatment machine according to FIG. 1 at a maintenance position.

FIG. 3A shows the curing unit 6 of the container treatment machine 1 at an operating position A and FIG. 3B shows it at a maintenance position W.

In FIG. 3A it can be seen that the curing unit 6 occupies a substantially perpendicular operating position A, so that the shielding element 62 defines a chamber together with the shielding enclosure 7. As has been described hereinbefore, light is thus prevented from exiting this area. In addition it can be seen that the carousel 3 rotates about the axis A. The distance between the curing unit 6 and the container 2 can be adjusted via the linear displacement unit 68.

FIG. 3B shows that, during maintenance, the linear displacement unit 68 is first moved outwards (in FIG. 3B to the right) away from the carousel 3 so that the boundary elements 62*b*, 62*d* of the shielding element 62 are released for pivoting away. Subsequently, the curing unit 6 is pivoted via the pivot joint 69 clockwise in FIG. 3B such that the light exit opening 63 is directed upwards and the curing unit 6 occupies the maintenance position W. The pivoting movement simultaneously triggers the safety switch 67 whereby the light source (here not shown) in the curing unit 6 is deactivated. Light radiation is thus prevented from continuing to exit during maintenance.

The pivot joint 69 makes it particularly easy to pivot the curing unit 6 to the maintenance position W at which the inner components of the curing unit 6 can easily be accessed.

Taking all this into account, the container treatment machine 1 for printing on containers 2, which is shown in FIGS. 1-3B, is used as follows: the containers 2 are placed in the container reception means 4 through the infeed star wheel 11. The containers 2 are then sequentially conveyed to the direct printing heads $\mathbf{5}_W$-$\mathbf{5}_K$ by means of the carousel 3, where they are printed on with light-curing printing inks of different colors (white, cyan, yellow, magenta, black). Subsequently, the light-curing printing inks are cured through UV light radiation by means of the curing unit 6. In order to prevent light radiation from falling onto the direct printing heads $\mathbf{5}_W$-$\mathbf{5}_K$, the container reception means 4 are provided with the shielding enclosure 7. The shielding element 62 of the curing unit 6 cooperates with the access opening 71 such that no light radiation arrives at the direct printing heads $\mathbf{5}_W$-$\mathbf{5}_K$. Subsequently, the containers 2 are advanced to additional processing stations by means of the discharge star wheel 12.

It follows that, making use of the container treatment machine 1 according to FIG. 1-3B, clogging of the nozzles of the direct printing heads $\mathbf{5}_W$-$\mathbf{5}_K$ as well as a deterioration of print quality through inadvertently cured printing ink can be avoided, and risks for the operating staff caused by UV light can be minimized. In addition, UV-sensitive components in the interior of the machine are prevented from damage.

It goes without saying that the features referred to in the above-mentioned embodiment are not limited to this special combination and can be provided in arbitrary other combinations.

What is claimed is:

1. A container treatment machine for printing on containers, comprising a transport unit used for conveying the containers in a plurality of container reception means, at least one direct printing head for printing with a light-curing printing ink, and a stationary curing unit for curing the printing ink on the containers by means of light radiation which is fixedly arranged on the container treatment machine, wherein each of the container reception means is provided with a shielding enclosure used for shielding off light radiation and having at least one access opening for the curing unit, and wherein the stationary curing unit is provided with a shielding element cooperating with the access opening of at least one shielding enclosure such that direct exit of light is prevented.

2. The container treatment machine according to claim 1, wherein the shielding enclosure being configured in a U-shape along a longitudinal axis (B) of the container reception means and the access opening being defined by the free ends of the U-shape substantially parallel to a conveying direction (T) of the transport unit.

3. The container treatment machine according to claim 1, the shielding element being formed like an umbrella extending from the edges of a light exit opening of the curing unit up to and beyond the edges of the access opening.

4. The container treatment machine according to claim 1, at least one of the shielding element or a housing of the curing unit comprising air exchange openings, which are each configured as a beam labyrinth by means of overlapping elements elements being spaced apart and displaced relative to one another such that a direct passage of light is not possible.

5. The container treatment machine according to claim 1, a distance between the curing unit and the container reception means being adjustable by means of a linear displacement unit.

6. The container treatment machine according to claim 5, the linear displacement unit being provided with a drive which is controllable via a machine control for adjusting the distance between the curing unit and the container reception means.

7. The container treatment machine according to claim 6, the machine control being in communication with a type management for retrieving adjustment parameters of the linear displacement unit.

8. The container treatment machine according to claim 1, the shielding element being configured such that it is adjustable via an adjustment mechanism, relative to a light source of the curing unit.

9. The container treatment system of claim 8, the adjustment mechanism provided with a plurality of elongate holes.

10. The container treatment machine according to claim 1, the the curing unit being configured such that it is pivotable by means of a pivot joint from an operating position (A) to a maintenance position (W).

11. The container treatment machine according to claim 10, the curing unit being arrestable at the operating position (A) by means of a locking element.

12. The container treatment machine according to claim 10 a safety sensor or safety switch being formed on the curing unit one of such that the curing unit is automatically deactivatable at the maintenance position (W).

13. The container treatment machine according to claim 1, the curing unit comprising an activated-carbon system for filtering waste air.

14. The container treatment machine according to claim 1, the curing unit having supply lines that are detachable by means of quick-release fasteners.

15. The container treatment machine according to claim 14, the supply lines being suspended by means of a tarable tackle system.

16. The container treatment machine of claim 1, the curing light employing UV light radiation as the means of light radiation.

17. A container treatment machine for printing on containers, comprising:

a transport unit used for conveying the containers in a container reception means, at least one direct printing head for printing with a light-curing printing ink, and curing unit for curing the printing ink on the containers by means of light radiation, each of the container reception means being provided with a shielding enclosure used for shielding off light radiation and having at least one access opening for the curing unit, and the curing unit provided with a shielding element cooperating with the access opening of at least one shielding enclosure such that direct exit of light is prevented, wherein a distance between the curing unit and the container reception means is adjustable by means of a linear displacement unit.

18. The container treatment machine according to claim 17, the linear displacement unit being provided with a drive which is controllable via a machine control for adjusting the distance between the curing unit and the container reception means.

19. The container treatment machine according to claim 18, the machine control being in communication with a type management for retrieving adjustment parameters of the linear displacement unit.

20. A container treatment machine for printing on containers, comprising:

a transport unit used for conveying the containers in a container reception means, at least one direct printing head for printing with a light-curing printing ink, and a curing unit for curing the printing ink on the containers by means of light radiation, each of the container reception means being provided with a shielding enclosure used for shielding off light radiation and having at least one access opening for the curing unit, and the curing unit is provided with a shielding element cooperating with the access opening of at least one shielding enclosure such that direct exit of light is prevented, wherein the curing unit is configured such that it is pivotable by means of a pivot joint from an operating position (A) to a maintenance position (W).

21. The container treatment machine according to claim 20, the curing unit being arrestable at the operating position (A) by means of a locking element.

22. The container treatment machine according to claim 20, a safety sensor or safety switch being formed on the curing unit one of such that the curing unit is automatically deactivatable at the maintenance position (W).

23. A container treatment machine for printing on containers, comprising:

a transport unit used for conveying the containers in a container reception means, at least one direct printing head for printing with a light-curing printing ink, and a curing unit for curing the printing ink on the containers by means of light radiation, each of the container reception means being provided with a shielding enclosure used for shielding off light radiation and having at least one access opening for the curing unit, and the curing unit is provided with a shielding element cooperating with the access opening of at least one shielding enclosure such that direct exit of light is prevented, wherein the curing unit is having supply lines that are detachable by means of quick-release fasteners.

24. The container treatment machine according to claim 23, the supply lines being suspended by means of a tarable tackle system.

25. A container treatment machine for printing on containers, comprising:

a transport unit used for conveying the containers in a container reception means, at least one direct printing head for printing with a light-curing printing ink, and a curing unit for curing the printing ink on the containers by means of light radiation, each of the container reception means being provided with a shielding enclosure used for shielding off light radiation and having at least one access opening for the curing unit, and the curing unit is provided with a shielding element cooperating with the access opening of at least one shielding enclosure such that direct exit of light is prevented, wherein the shielding element is configured such that it is adjustable relative to a light source of the curing unit via an adjustment mechanism being provided with a plurality of elongate holes.

* * * * *